US006620242B1

(12) United States Patent
Behr et al.

(10) Patent No.: US 6,620,242 B1
(45) Date of Patent: Sep. 16, 2003

(54) DEVICE FOR APPLYING AND/OR SPREADING LIQUID OR PASTY SUBSTANCES FOR COATING SURFACES

(75) Inventors: Rainer Behr, Heidenheim (DE); Siegbert Hermann, Everswinkel (DE)

(73) Assignees: Quickwood GmbH, Heidenheim (DE); Osterman & Scheiwe GmbH & Co.KG, Munster (DE)

( * ) Notice: Subject to any disclaimer, the term of this patent is extended or adjusted under 35 U.S.C. 154(b) by 0 days.

(21) Appl. No.: 09/807,909

(22) PCT Filed: Oct. 21, 1999

(86) PCT No.: PCT/EP99/07984

§ 371 (c)(1),
(2), (4) Date: Aug. 2, 2001

(87) PCT Pub. No.: WO00/24524

PCT Pub. Date: May 4, 2000

(30) Foreign Application Priority Data

Oct. 23, 1998 (DE) ..... 198 48 916

(51) Int. Cl.[7] ..... B05C 1/02

(52) U.S. Cl. ..... 118/264; 118/258; 118/244; 15/77; 15/88.3; 15/181

(58) Field of Search ..... 118/264, 258, 118/244; 15/77, 88.3, 88.2, 181

(56) References Cited

U.S. PATENT DOCUMENTS

| | | | | |
|---|---|---|---|---|
| 3,084,367 A | | 4/1963 | Radinse | |
| 5,237,716 A | * | 8/1993 | Lisec | 15/77 |

FOREIGN PATENT DOCUMENTS

| | | |
|---|---|---|
| DE | 93 09 920.7 | 9/1993 |
| DE | 298 21 325 U1 | 6/1999 |
| GB | 655262 | 6/1951 |
| JP | 63240965 A | 10/1988 |

* cited by examiner

*Primary Examiner*—Laura Edwards
(74) *Attorney, Agent, or Firm*—Davis & Bujold, P.L.L.C.

(57) ABSTRACT

The invention relates to a device for applying and/or spreading liquid or pasty substances for coating surfaces, especially paists, varnishes and lacquers on the surface of objects (2). The device has at least two pinions (7, 7') the axes of which are arranged substantially parallel in relation to the object's surface to be coated. The spindles are provided with circumferential brush-like spreaders (8). At least one spindle can be moved across the surface of the object, with the object being moved along the brush-like spreaders.

21 Claims, 3 Drawing Sheets

DEVICE FOR APPLYING AND/OR SPREADING LIQUID OR PASTY SUBSTANCES FOR COATING SURFACES

FIELD OF THE INVENTION

The present invention relates to an apparatus for applying and/or spreading liquid or pasty substances for coating surfaces, in particular paints, varnishes and lacquers, on the surfaces of workpieces.

BACKGROUND OF THE INVENTION

It is known to coat the surfaces of workpieces with liquid or pasty substances, for example paints, varnishes or lacquers, so as to protect them and/or to improve their appearance. To this end, the said substances are generally sprayed, rolled or poured onto the surfaces of the workpieces.

When rolling or pouring paints, varnishes or lacquers onto the surfaces of workpieces it is virtually impossible to obtain thin and very uniform coatings, in particular when the surfaces of the workpieces are uneven.

In the case of such surfaces, for example profiled surfaces, application of the coating substance by means of a spraying technique therefore remains the sole option for obtaining a somewhat more uniform coating. However, it is known even in the spraying technique that larger quantities of coating substance collect in small depressions on the surface than in the surrounding regions. This results in a locally thicker layer thickness when the coating has been applied. Particularly when the coating substance is a paint, this may result in a nonuniform intensity of color.

A further, generally known problem with the use of the spraying technique is the high consumption of coating substance and the environmental impact associated therewith, since during normal application by spraying, the process causes a not inconsiderable part of the coating substance to fall next to the workpiece to be coated.

It is therefore the object of the invention to apply and/or uniformly spread liquid or pasty substances for coating surfaces, in particular paints, varnishes and lacquers, on the surfaces of workpieces, in particular also on slightly profiled surfaces.

SUMMARY OF THE INVENTION

According to the invention, the object is achieved by an apparatus for applying and/or spreading liquid or pasty substances.

The apparatus according to the invention is ideally suitable for spreading liquid or pasty substances for coating surfaces, in particular, paints, varnishes or lacquers, which have been applied onto the surface(s) of the workpieces in the apparatus or in a preceding manufacturing step. Brush-like spreaders which are fitted to the circumference of spindles are used for the application and/or spreading. In the process, at least one of the spindles having the brush-like spreaders moves approximately parallel over the workpiece surface to be coated, while the workpiece is at the same time moved past the apparatus by a conveying device.

Surface profiles and slight unevennesses of the surface are absorbed by the elasticity in the brush-like spreaders to the extent that even here application and/or uniform spreading of the liquid or pasty substance takes place.

The practical use of the apparatus according to the invention resides in installing it as a coating station between a station for the substance application by means of a known technique, for example by means of a roller machine or by pouring, and a generally known and conventional drying station, for example a UV drying instalation, or in placing it as a coating station having integrated substance application directly in front of the drying station.

The arrangement of the brush-like spreaders fulfils the purpose of bringing the applied excess of coating substance into regions, such as depressions or profiled areas, and of spreading it there. A very uniform coating over the entire surface can thereby be achieved.

In a particularly advantageous manner, in one embodiment of the invention the spindles rotate about their own axis and at least two of the spindles are guided over the workpieces to be coated in a rotational movement running approximately parallel to the surface of the workpiece by a common rotor. A further rotating spindle, but which is fitted with its axis fixed in position, can be fitted at that end of the coating station which faces the drying station. This positionally fixed spindle with its own driving unit has the task of leveling the processing traces which may still be detectable and which the moveable spindles might have left behind on the surface to be coated.

In a further, very favorable embodiment, the brush-like spreaders are fitted on the circumference of the spindles at an acute angle to the axis of the said spindles. Because of the rotations of the spindles and the translatory movement of the workpieces past the apparatus, the friction of the bristles against the surface which is to be coated results in an equalizing movement of the bristles. This means that the arrangement of the bristles at an acute angle to the axis of the spindles can result in an oscillating movement of the bristles on the surface of the workpiece which is to be coated, which movement contributes to a very uniform spreading of the liquid or pasty coating substance. The coating substance is virtually "rubbed" into the surface.

In addition, because of the oscillating movement of the brush-like spreaders and the virtually ideal spreading of the applied coating substance which is made possible as a result, a considerable quantity of this coating substance can be saved.

In a further, very advantageous embodiment of the invention, the brush-like spreaders are fitted on disk-like holders which can be plugged onto the spindles. They can be pushed onto the spindle in alternating fashion with one or more spacer disks in a manner secure against rotation. The individual elements can then finally also be clamped with respect to one another on the spindle by means of a fastening device. In this case, the use of angle-equalizing disks also makes it possible for different angular positions of the bristles with respect to the axis of the spindle to be realized in a simple manner.

This very flexible design of the coating station can thus be adapted rapidly and simply to virtually any desired task and any coating substance. Thus, for example by a change in the distance between the brush-like spreaders, the installation can be adapted without great outlay to the present situation, for example to the viscosity of the coating substance used or to the condition of the surface of the workpieces to be coated. The advantages obtained thereby in the saving on set-up time, manufacturing sequence and ultimately in the logistics are obvious.

However, the arrangement of the brush-like spreaders on the disk-like holders provides yet further advantages, particularly also in the handling of the parts. Thus, the disk-like holders together with their brush-like spreaders are considerably more easy to handle during storage and dispatch and are damaged less frequently than complete spindles fitted with brush-like spreaders.

The advantageous properties of the apparatus according to the invention are also further assisted in that the rotor, the moveable spindles and the at least one positionally fixed spindle can be set completely independently of one another in their rotational speed and direction of rotation.

If the coating station is used with an integrated substance application, as one of the advantageous refinements of the invention envisages, the liquid or pasty substance for coating surfaces can be picked up by the revolving brush-like spreaders on that side of the spindles which faces away from the surfaces to be coated.

In order to avoid workpieces which are to be coated from tilting and rising up between the spindles having the brush-like spreaders, in a particularly advantageous embodiment of the invention, holding-down clamps can be provided between the spindles. In a particularly favorable design, these holding-down clamps, which can partly also be moved together with the moveable spindles, have beveled or rounded regions on their edge regions facing the spindles.

BRIEF DESCRIPTION OF THE DRAWINGS

Further advantageous refinements of the invention emerge from the other subclaims and from the exemplary embodiment described below with reference to the drawings, in which:

DETAILED DESCRIPTION OF THE PREFERRED EMBODIMENTS

Figure 1:
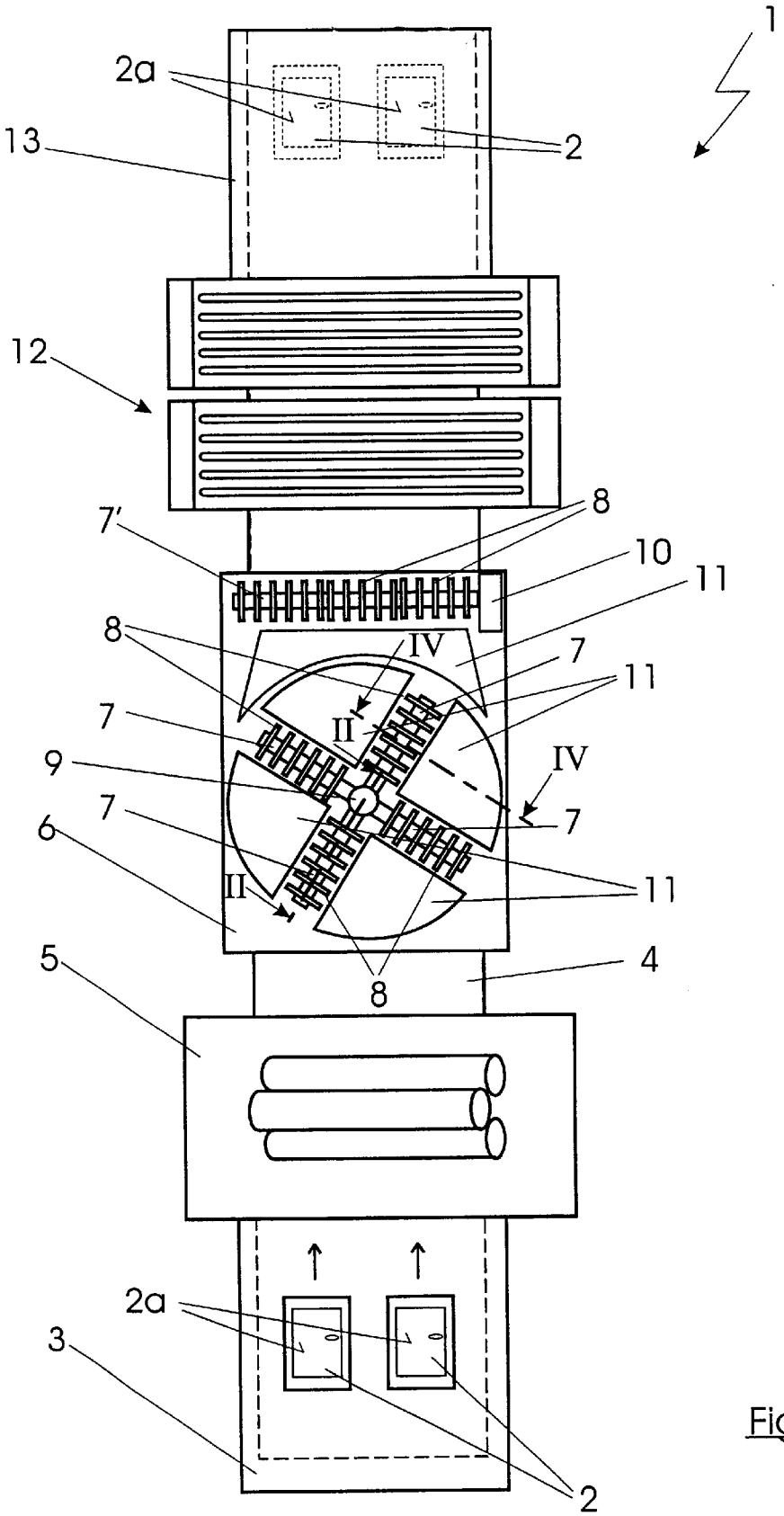
FIG. 1 shows a schematic illustration of a possible manufacturing line for coating surfaces of workpieces.

In FIG. 1, a possible manufacturing line 1 for coating surfaces 2*a* of workpieces 2 can be seen. The manufacturing line 1 has a delivery table 3 from which the workpieces 2 to be coated are moved through the manufacturing line 1 on a conveying device 4, for example a conveyor belt 4.

In the exemplary embodiment illustrated, this is followed by a roller machine 5 which is designed in a known manner and in which the actual application of the coating substance, in particular paint in this case, onto the surface 2*a* of the workpieces 2 takes place. Following this roller machine 5 there is then, for the purpose of application in the regions not coated by the roller machine, for example profiled areas, and for the uniform spreading of the paint, a coating station 6 having four moveable spindles 7 and a spindle 7' which is fitted with its axis fixed in position with respect to the apparatus. The spindles 7, 7' bear brush-like spreaders 8 on their circumference. In this arrangement, the four moveable spindles 7 are arranged such that they can rotate about a common rotor 9 and the positionally fixed spindle 7' is arranged at the end of the coating station, in the direction of passage of the workpieces 2, and has its own driving unit 10. In the operating state of the coating station 6 the moveable spindles 7 and the positionally fixed spindle 7' rotate about their respective axis.

After the paint has been deposited onto the surface 2*a* of the workpieces 2 to be coated in the roller machine 5, the workpieces 2 pass through the coating station 6. In the process, they move on the conveyor belt 4 past the rotating spindles 7, 7' with the moveable spindles 7 additionally still moving about the common rotor 9. As this happens, the brush-like spreaders 8 brush at least with the ends of their bristles over the surface 2*a* to be coated, apply more paint in the process and/or spread the paint which has been applied very uniformly. After the processing by the brush-like spreaders 8 of the moveable spindles 7 processing traces may possibly still remain on the surfaces 2*a* of the workpieces 2. These processing traces are leveled by the rotating spindle 7', which is fitted in a positionally fixed manner at the end of the coating station 6.

Holding-down clamps 11 can be seen between the spindles 7, 7', the said clamps having the task of preventing the workpieces 2 from tilting and rising up in the coating station 6.

After having passed through the coating station 6, the workpieces 2 are conveyed by the conveyor belt 4 to a drying station 12 of a known type of construction. The drying station 12 is indicated here schematically as a two-stage UV-drying installation 12. After having passed through the drying station 12, the workpieces 2 pass to a removal table 13 and can be removed there for further processing, if that is desired, or for dispatch of the workpieces 2.

The very simple manufacturing line 1 selected for the schematic illustration in FIG. 1 is, of course, just one option for the use of the coating station 6. Of course, other, larger manufacturing lines 1 are also conceivable, in particular those having multi-stage coating processes. Thus, for example after the UV-drying installation 12, grinding of the surfaces 2*a* could take place and this could then be followed by one or more further applications of paint by subsequent coating stations 6 and a plurality of further drying stations 12 before the workpieces pass onto the removal hi table 13. Also, one or more coating stations 6 having an integrated application of paint are conceivable; they could even further simplify the manufacturing line 1.

Figure 2:
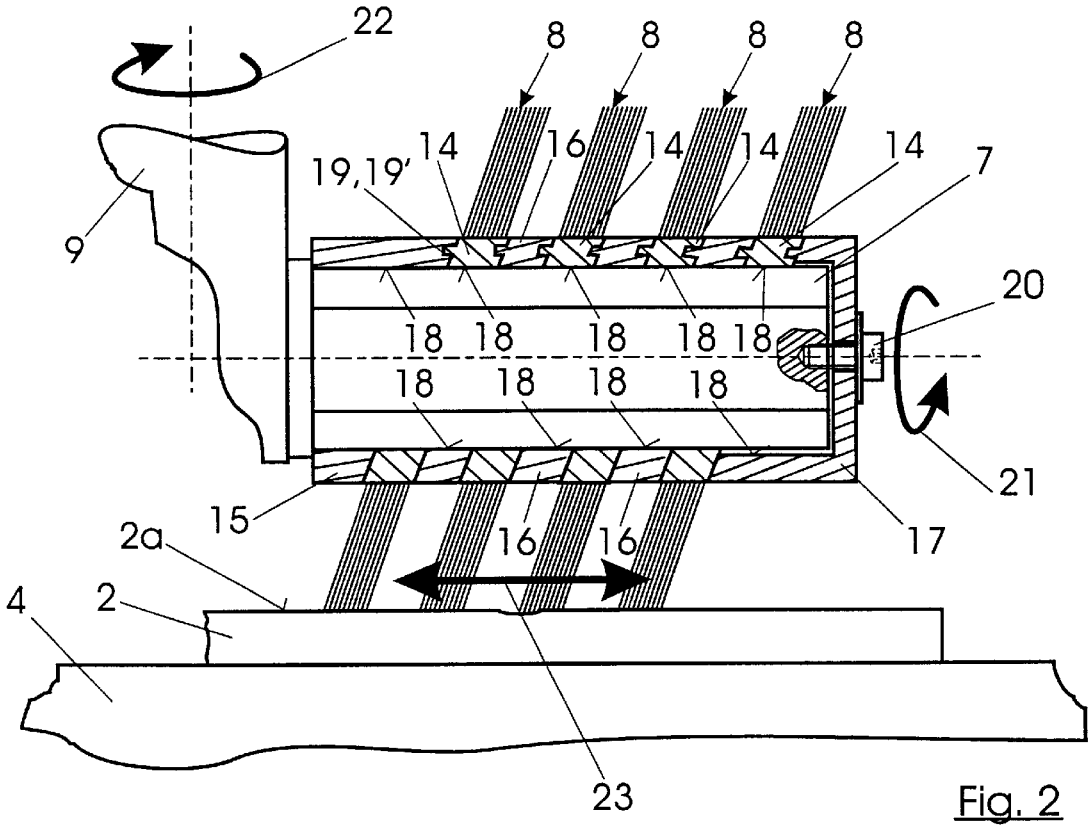
FIG. 2 shows a sectional illustration through a spindle having brush-like spreaders.

FIG. 2 shows a section through one of the moveable spindles 7 together with a rotor 9, which is just illustrated schematically. A workpiece 2 lying on the conveyor belt 4 which is indicated can be seen below the moveable spindle 7 with the bristles of the brush-like spreaders 8 brushing over it.

The design described below applies by analogy to the design of the positionally fixed spindle 7'.

A plurality of disk-like holders 14 are clamped onto the spindle 7 together with an inner closure element 15, a plurality of spacer disks 16 and an outer closure element 17. In this arrangement, both the spindle 7 and central openings 18 of the disk-like holders 14, the spacer disks 16 and the two closure elements 15, 17, by means of which openings all the latter can be clamped onto the spindle 7, are designed as a hexagon profile.

The hexagon profile means that the disk-like holders 14, the spacer disks 16 and the two closure elements 15, 17 can no longer rotate with respect to the spindle 7 after having been clamped on. In addition, all of the abovementioned elements also have projections 19 and depressions 19' which engage in the depressions 19' and the projections 19 of the following element in each case and thus permit an interlocking connection of the disk-like holders 14, the spacer disks 16 and the two closure elements 15, 17 with respect to one another.

The outer closure element 17, which is clamped on on that side of the spindle 7 which faces away from the rotor 9, is of cup-like design. After being clamped onto the spindle 7 it can be clamped against the spindle 7 with a fastening element 20, via a screw 20 in this case. The disk-like holders 14, the spacer disks 16 and the inner closure element 15 are therefore also clamped with respect to one another. A non-positive fastening of the disk-like holders 14, the spacer disks 16 and the two closure elements 15, 17 is therefore additionally also obtained.

The entire system is very flexible and the individual parts can easily be displaced and/or interchanged in order to refit the coating station 6.

In the exemplary embodiment illustrated, the disk-like holders 14 are constructed in such a manner that they are clamped on at an acute angle deviating from 90° with respect to the axis of the spindle 7. In this case, the two closure elements 15, 17 additionally also serve as angle-equalizing disks 15, 17 which have, on their one side, the acute angle which deviates from 90° and, on their other side, a right angle with respect to the axis of the spindle 7.

As is indicated by the arrow 21 in FIG. 2, the moveable spindle 7 rotates about its own axis. In this arrangement, the rotational speed and the direction of rotation of each moveable spindle 7 can be set independently of the other moveable spindles 7. In addition, all four moveable spindles 7 rotate jointly about the rotor 9, as is indicated by the arrow 22. A further movement component is a translation of the workpieces 2 underneath the coating station 6 which is produced by the conveyor belt 4.

The spindle 7' which is fitted in a positionally fixed manner in principle has the same design, with the fastening element 20 coming to rest here on the side facing away from the driving unit 10 of the positionally fixed spindle 7'. In addition, only two movements take place here, namely the rotation of the positionally fixed spindle 7' and the translation of the workpieces 2.

By means of the combination of the obliquely set, brush-like spreaders 8, the rotation of the spindles 7, 7' and because of the friction of the bristles of the brush-like spreaders 8 against the surface 2*a* to be coated, an oscillating, equalizing movement (indicated by the arrow 23) of the bristles of the brush-like spreaders 8 occurs, as a result of which the paint which has been applied is spread in an ideal manner over the surface 2*a* of the workpieces 2 passing below the coating station 5.

Figure 3:
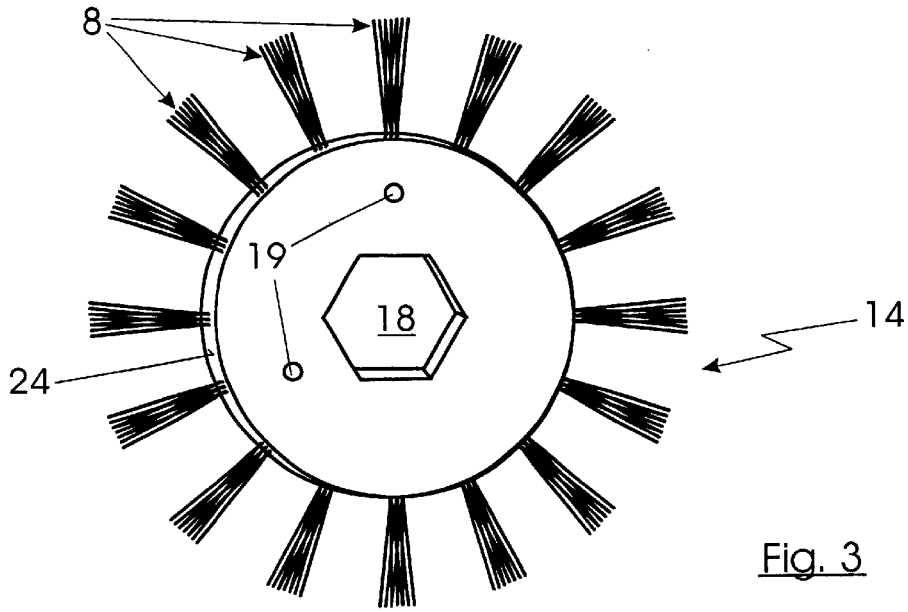
FIG. 3 shows a disk-like holder with brush-like spreaders.

In FIG. 3, one of the disk-like holders 14 can be seen. The spacer disks 16, which are available in a number of thicknesses, have virtually the same design as the disk-like holders 14, but without having brush-like spreaders 8.

Projections 19 can be seen on the disk-like holder 14, which projections engage in an interlocking manner in the following, disk-like holder 14 and the following spacer disk 16, when the said holder and spacer disk are clamped together onto the spindle 7, 7' and clamped in place. In this arrangement, the central opening 18 is formed in the hexagon profile which has already been described, and the brush-like spreaders 8 are glued in place in cutouts (which cannot be seen in the illustration) which point radially to the central opening 18 on a surface 24 forming the circumference of the disk-like holder 14.

Of course, different disk-like holders 14 having differing brush-like spreaders 8 are conceivable. In particular, the length and stiffness of the bristles of the brush-like spreaders 8 and their angular setting give rise to a very large number of options which can be used easily, by simple refitting of the coating station 6, for adapting the coating station 6 in a flexible manner to the surfaces 2*a* to be coated in each case of the respective workpieces 2.

Figure 4:
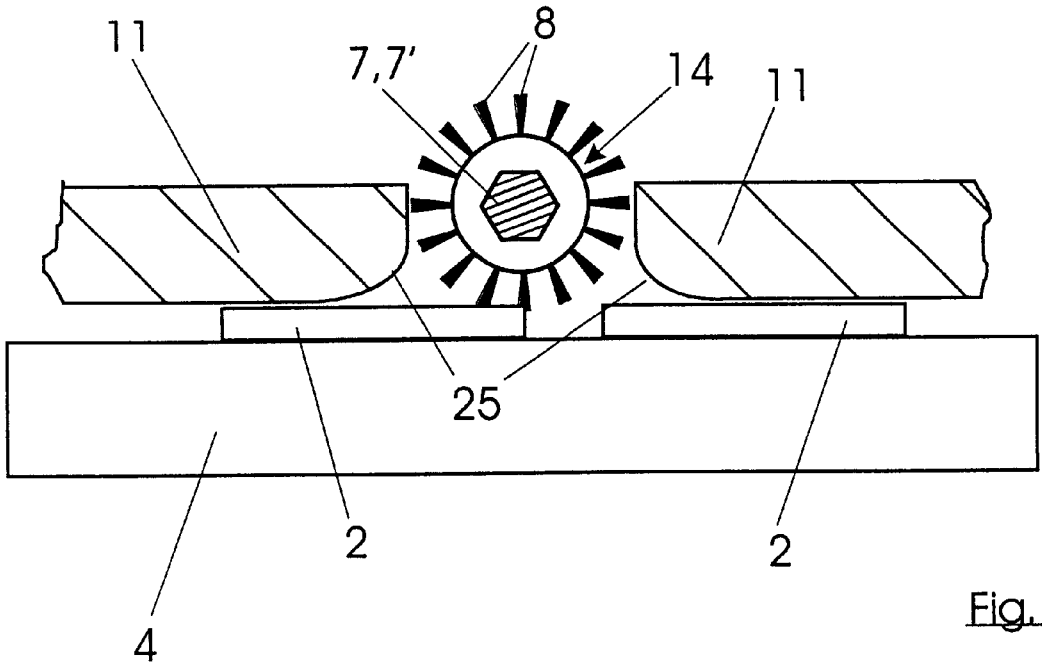
FIG. 4 shows a schematic section through a holding-down clamp according to the line IV—IV in FIG. 1.

In FIG. 4, a section through the holding-down clamp 11 can be seen. Holding-down clamps 11 of this type are in each case arranged between the spindle 7, 7' with their brush-like spreaders 8 and move partially together with the moveable spindles 7. They have the task of preventing the workpieces 2 which are to be coated from tilting and rising up between the spindles 7, 7'. Such rising up of the workpieces 2, which may occur predominantly in the case of wooden workpieces 2 which have already been damaged and distorted, could damage the coating station 6 and would in any case force the entire manufacturing line 1 to come to a standstill.

The holding-down clamps 11 have rounded or beveled regions on their edge regions 25 which face the spindles 7, 7', with the result that the processing of the workpieces 2 to be coated by the brush-like spreaders 8 is not adversely affected.

What is claimed is:

1. An apparatus for one of applying and spreading a coating onto a surface (2*a*) of a workpiece (2), the apparatus comprising:

at least two movable spindles and one fixed spindle (7, 7'), with each of the spindles (7, 7') having a rotational axis arranged approximately parallel to the surface (2*a*) of the workpiece (2) to be coated,.each of the spindles (7, 7') having a plurality of brush spreaders (8) supported about a circumference thereof, and the at least two movable spindles (7) being movable over the surface (2*a*) of the workpiece (2); and the two movable spindles (7) are supported by a rotatable common rotor (9), the two movable spindles and the one fixed spindle (7, 7') each rotate about a respective rotational axis, and the two movable spindles are guided such that the two movable spindles (7) rotate in a plane defined by the rotatable common rotor (9).

2. The apparatus according to claim 1, wherein the rotational axis of one of the two spindles (7') is fixed, and a driving unit (10) supplies rotational drive to the one fixed spindle (7') so that the one fixed spindle (7') only rotates.

3. The apparatus according to claim 1, wherein the brush spreaders (8) are arranged around the circumference of each of the two spindles (7, 7') so as to extend at an acute angle with respect to the rotational axis of the respective spindle (7, 7').

4. The apparatus according to claim 1, wherein a rotational speed and a rotational direction of the common rotor (9) and a rotational speed and rotational direction of the driving unit (10) are controllable independently of one another.

5. The apparatus according to claim 1, wherein the coating is deposited on surface (2*a*) of the workpiece (2) by a machine (5) prior to the workpiece (2) entering the apparatus.

6. The apparatus according to claim 1, wherein the coating is deposited on surface (2*a*) of the workpiece (2) when the workpiece (2) is located within the apparatus.

7. The apparatus according to claim 1, wherein each spindle (7, 7') comprises a plurality of disk holders (14) with a plurality of cutouts formed about a circumference thereof, and the spreader brushes (8) are glued in the cutouts of the disk holders (14).

8. The apparatus according to claim 7, wherein each disk holder (14) has a central opening (18) therein, and the central opening (18) of each disk holders (14) matingly engages with one of the two spindles (7, 7') so that the disk holder (14) rotates with the respective spindles (7, 7').

9. The apparatus according to claim 7, wherein a spacer disk (16) is located between adjacent one of the disk holders (14), and each spacer disk (16) has a central opening (18) therein, and the central opening (18) of the spacer disk (16) matingly engages with one of the two spindles (7, 7') so that the spacer disk (16) rotates with the respective spindle (7, 7').

10. The apparatus according to claim 8, wherein a central opening (18) is formed in a plurality of spacer disks (16) and in the plurality of disk holders (14), the spreader brushes (8) extend from the plurality of disk holders (14) and the central openings are formed in at least the plurality of disk holders (14) such that the brush spreaders (8) extend therefrom at an acute angle with respect to the rotational axis of the respective spindle (7, 7').

11. The apparatus according to claim 6, wherein a central opening (18) is formed in a plurality of spacer disks (16) and in a plurality of disk holders (14), the spreader brushes (8) extend from the plurality of disk holders (14) and the central openings are formed in at least the plurality of disk holders (14) such that the brush spreaders (8) extend therefrom at an acute angle with respect to the rotational axis of the respective spindle (7, 7'), and the plurality of spacer disks (16) and the plurality of disk holders (14) are sandwiched between a pair of angle-equalizing elements (15,17), and each mating surface of the plurality of spacer disks (16), the plurality of disk holders (14) and the pair of angle-equalizing elements (15, 17) has an interlocking connection.

12. The apparatus according to claim 2, wherein a plurality of spindles (7) are supported by the rotatable common rotor (9), and each of the plurality of spindles (7) has a plurality of spacer disks (16) and a plurality of disk holders (14) with the spreader brushes (8) extend therefrom; the plurality of spacer disks (16) and the plurality of disk holders (14) are sandwiched between a pair of angle-equalizing elements (15, 17), and a fastening element (20) is attached to a remote end of each of the plurality of spindles (7) to retain the plurality of spacer disks (16), the plurality of disk holders (14) and the pair of angle-equalizing elements (15, 17).

13. The apparatus according to claim 1, wherein a plurality of spindles (7) are supported by the rotatable common rotor (9), and a hold down clamp (11) cooperates with each adjacent pair of the plurality of spindles (7).

14. The apparatus according to claim 13, wherein each hold down clamp (11) has rounded edges.

15. The apparatus according to claim 1, wherein the apparatus is used in combination with a drying station (12) and a conveyor (4) conveys the workpiece (2) from the apparatus to the drying station (12).

16. The apparatus according to claim 1, wherein the apparatus is used in combination with a machine (5) and a conveyor (4) conveys the workpiece (2) from the machine (5) to the apparatus.

17. The apparatus according to claim 1, wherein the apparatus is used in combination with a machine (5) and a drying station (12), and a conveyor (4) conveys the workpiece (2) from the machine (5) to the apparatus and then conveys the workpiece (2) from the apparatus to the drying station (12).

18. The apparatus according to claim 1, wherein a plurality of spindles (7) are supported by the rotatable common rotor (9), at least one region lying between the spindles (7) supported by the common rotor (9) has a holding-down clamp (11), the holding-down clamp (11) extends substantially parallel to the surface (2*a*) of the workpiece (2) and, on edge regions (25) of the holding-down clamp (11) facing the spindles are one of rounded and beveled.

19. An apparatus for one of applying and spreading a coating onto a surface (2*a*) of a workpiece (2), the apparatus comprising:

four movable spindles and one fixed spindle (7, 7'), with each of the spindles (7, 7') having a rotational axis arranged approximately parallel to the surface (2*a*) of the workpiece (2) to be coated, each of the spindles (7, 7') having a plurality of brush spreaders (8) supported about a circumference thereof, and the four movable spindles (7) being movable over the surface (2*a*) of the workpiece (2); and the four movable spindles (7) are supported by a rotatable common rotor (9), the four movable spindles and the one fixed spindle (7, 7') each rotate about a respective rotational axis, and the four movable spindles are guided such that the four movable spindles (7) rotate as the four movable spindles (7) move in a plane defined by the rotatable common rotor (9).

20. The apparatus according to claim 19, wherein the brush spreaders (8) are arranged around the circumference of each of the spindles (7, 7') so as to extend at an acute angle with respect to the rotational axis of the respective spindle (7, 7'), and a rotational speed and a rotational direction of the common rotor (9) and a rotational speed and rotational direction of a driving unit (10) for the one fixed spindle (7') are independently controllable.

21. The apparatus according to claim 19, wherein the apparatus is used in combination with a machine (5) and a drying station (12), and a conveyor (4) conveys the workpiece (2) from the machine (5) to the apparatus and then conveys the workpiece (2) from the apparatus to the drying station (12).

* * * * *

UNITED STATES PATENT AND TRADEMARK OFFICE

CERTIFICATE OF CORRECTION

PATENT NO. : 6,620,242 B1
DATED : September 16, 2003
INVENTOR(S) : Rainer Behr and Siegbert Hermann It is certified that error appears in the above-identified patent and that said Letters Patent is hereby corrected as shown below:

Title page,
Item [57], ABSTRACT,
Line 4, change “paists,” to -- paints, --.

Column 2,
Line 4, change “instalation” to -- removal table --.

Column 4,
Line 36, change “removal hi table” to -- removal table --.
Line 66, change “clamped on on that side” to -- clamped on that side --.

Column 6,
Line 24, change “to be coated,.each” to -- to be coated, each --

Signed and Sealed this

Tenth Day of August, 2004

JON W. DUDAS
*Acting Director of the United States Patent and Trademark Office*